US009435125B2

(12) United States Patent
Wakebe

(10) Patent No.: US 9,435,125 B2
(45) Date of Patent: Sep. 6, 2016

(54) ROOFING MATERIAL AND ROOF STRUCTURE

(71) Applicant: NIPPON STEEL & SUMIKIN COATED SHEET CORPORATION, Tokyo (JP)

(72) Inventor: Takahiko Wakebe, Hyogo (JP)

(73) Assignee: Nippon Steel & Sumikin Coated Sheet Corporation, Tokyo (JP)

( * ) Notice: Subject to any disclaimer, the term of this patent is extended or adjusted under 35 U.S.C. 154(b) by 0 days.

(21) Appl. No.: 14/493,724

(22) Filed: Sep. 23, 2014

(65) Prior Publication Data

US 2015/0089885 A1 Apr. 2, 2015

(30) Foreign Application Priority Data

Sep. 30, 2013 (JP) ..... 2013-203214
Dec. 17, 2013 (JP) ..... 2013-260449

(51) Int. Cl.

| | |
|---|---|
| ***E04D 1/00*** | (2006.01) |
| ***E04D 1/18*** | (2006.01) |
| ***E04D 3/24*** | (2006.01) |
| ***E04D 3/30*** | (2006.01) |
| ***E04D 3/362*** | (2006.01) |
| ***E04D 3/363*** | (2006.01) |
| ***E04D 3/367*** | (2006.01) |
| ***E04D 3/365*** | (2006.01) |
| ***E04D 3/368*** | (2006.01) |

(52) U.S. Cl.

CPC . *E04D 1/18* (2013.01); *E04D 3/24* (2013.01); *E04D 3/30* (2013.01); *E04D 3/362* (2013.01); *E04D 3/363* (2013.01); *E04D 3/364* (2013.01); *E04D 3/365* (2013.01); *E04D 3/368* (2013.01)

(58) Field of Classification Search

CPC ..... E04D 3/24; E04D 3/30; E04D 3/363; E04D 3/362; E04D 3/364; E04D 3/365; E04D 3/368

USPC ..... 52/105, 588.1, 519, 528, 533, 534, 537

See application file for complete search history.

(56) References Cited

U.S. PATENT DOCUMENTS

| | | | | | |
|---|---|---|---|---|---|
| 996,750 | A | * | 7/1911 | Dolph | 52/531 |
| 1,122,492 | A | * | 12/1914 | Galbraith | 52/522 |
| 1,389,979 | A | * | 9/1921 | Rahr et al. | 52/105 |
| 1,417,641 | A | * | 5/1922 | Stuffings | 52/105 |
| 1,597,993 | A | * | 8/1926 | Meurer | 52/529 |
| 1,609,127 | A | * | 11/1926 | Rachlin | 52/531 |
| 1,741,566 | A | * | 12/1929 | Harris | E04D 1/26 52/105 |
| 2,004,879 | A | * | 6/1935 | Matthews et al. | 52/524 |
| 2,171,010 | A | * | 8/1939 | Schuetz et al. | 52/555 |
| 2,173,774 | A | * | 9/1939 | Birch et al. | 52/522 |

(Continued)

FOREIGN PATENT DOCUMENTS

JP 08-277606 A 10/1996

*Primary Examiner* — Adriana Figueroa

(74) *Attorney, Agent, or Firm* — Renner, Otto, Boisselle & Sklar, LLP

(57) ABSTRACT

The present invention relates to roofing material to be connected with a further roofing material under a condition that respective sides of the roofing material and the further roofing material are overlapped with each other, including a main body having a substantially flat plate shape and a fitting part formed at an end of the main body. The roofing material further includes at least one positioning marker which is provided to the fitting part so as to indicate a position of an overlap between the respective sides.

4 Claims, 10 Drawing Sheets

(56) References Cited

U.S. PATENT DOCUMENTS

| | | | | | |
|---|---|---|---|---|---|
| 2,188,454 | A * | 1/1940 | Braddock | 52/531 | |
| 2,211,508 | A * | 8/1940 | Little | E04F 13/12 | 52/521 |
| 3,347,001 | A * | 10/1967 | Cosden | 52/105 | |
| 3,380,214 | A * | 4/1968 | Stevens | E04D 1/265 | 52/478 |
| 3,927,501 | A * | 12/1975 | Allen et al. | 52/555 | |
| 4,134,244 | A * | 1/1979 | Sjolander | 52/506.1 | |
| 4,279,106 | A * | 7/1981 | Gleason et al. | 52/100 | |
| 4,466,226 | A * | 8/1984 | Rohner | E04D 1/20 | 52/105 |
| 4,499,702 | A * | 2/1985 | Turner | 52/555 | |
| 4,601,135 | A * | 7/1986 | Ellis | E04D 1/30 | 52/529 |
| 5,613,337 | A * | 3/1997 | Plath et al. | 52/533 | |
| 5,881,501 | A * | 3/1999 | Guffey | E04D 3/30 | 52/478 |
| 2007/0289245 | A1* | 12/2007 | Welch | 52/592.1 | |
| 2009/0049765 | A1* | 2/2009 | Grant | 52/105 | |
| 2011/0041421 | A1* | 2/2011 | Jenkins | 52/105 | |

* cited by examiner

ROOFING MATERIAL AND ROOF STRUCTURE

CROSS-REFERENCE TO RELATED APPLICATIONS

The application is based upon and claims the benefit of priorities of Japanese Patent Application No. 2013-203214, filed on Sep. 30, 2013, and Japanese Patent Application No. 2013-260449, filed on Dec. 17, 2013, the entire contents of which are incorporated herein by reference.

TECHNICAL FIELD

The present invention relates to a roofing material for formation of a roof of a building such as a house and a factory and a roof structure constituted by the roofing materials.

BACKGROUND ART

A roof of a building such as a house and a factory can be formed by installing a plurality of roofing materials each having a substantially rectangular shape on a roof base in a vertical direction and in a lateral direction sequentially. In a case of a roof having such a roof structure, respective sides of the two roofing materials adjacent to each other in a lateral direction of the roof, i.e. in a direction perpendicular to an inclining direction of the roof are overlapped each other (e.g. see document 1 [JP 08-277606 A]). FIG. 11 shows a partial cross-sectional view of one example of the above type of roof structure. Each of roofing materials 100 for this roof structure includes a cover part 40 having a substantially flat plate shape formed at one of opposite ends thereof and a water barrier part 41 having a wave shape in a sectional view formed at the other end thereof. The water barrier part 41 includes a plurality of protrusions 41*a*. The adjacent two roofing materials 100 are installed on a roof base 6 such that the water barrier part 41 of one of the adjacent two roofing materials 100 is covered by the cover part 40 of the other one of the adjacent two roofing materials 100. The adjacent two roofing materials 100 are installed under a condition that respective sides thereof are overlapped each other and thereby the above roof structure can improve a water barrier property of the roof and also has a water barrier function owing to the plurality of protrusions 41*a* formed on the water barrier part 41.

In a case where the respective sides of the two roofing materials are overlapped as mentioned above, when a lateral overlap between the sides is too small, rainwater may arrive at the roof base through the overlap and thus a water barrier property of the roof is likely to be insufficient. In contrast, when the lateral overlap between the sides is too long, the number of roofing materials 100 to be used is likely to increase, and therefore workability and appearance of the roof are likely to deteriorate. In view of this, in a process of overlapping the two roofing materials 100 and 100, it is necessary to adjust the length of the lateral overlap to a predetermined length. As a result, such adjustment of the length of the overlap may take troubles and time, and therefore workability may be insufficient. Further, precision of the adjustment of the length of the overlap may also strongly depend on a worker's experience, and thus precision of the installation may be unstable.

SUMMARY

In view of the above insufficiency, the present invention has aimed to propose a roofing material enabling easy and precise adjustment of a dimension of an overlap and having improved workability, and a roof structure including the roofing materials.

The roofing material in accordance with the present invention is configured to be connected with a further roofing material under a condition that respective sides of the roofing material and the further roofing material are overlapped with each other, the roofing material including: a main body having a substantially flat plate shape; and a fitting part formed at an end of the main body, the roofing material further including at least one positioning marker which is provided to the fitting part so as to indicate a position of an overlap between the respective sides.

In a preferred aspect of the roofing material, the at least one positioning marker is formed by partially cutting out the fitting part.

In a preferred aspect of the roofing material, the roofing material includes, as the at least one positioning marker provided to the fitting part, two positioning markers which are a first positioning marker and a second positioning marker, the first positioning marker and the second positioning marker being formed such that a distance of the first positioning marker from one of opposite side ends of the fitting part is substantially equal to a distance of the second positioning marker from the other of the opposite side ends of the fitting part.

The roof structure in accordance with the present invention includes two or more roofing materials as described above, adjacent two roofing materials of the two or more roofing materials being connected under a condition that respective sides of the adjacent two roofing materials are overlapped with each other so that one side end of the fitting part of one of the adjacent two roofing materials conceals the at least one positioning marker of the other of the adjacent two roofing materials.

The roofing material in accordance with the present invention includes the at least one positioning marker which serves as a reference position of an overlap between the respective sides of the roofing material and the further roofing material which are adjacent to each other. Therefore, when the roofing material and the further roofing material are connected, it is possible to easily and precisely adjust the dimension of the overlap between the roofing material and the further roofing material. Thereby, it is possible to easily connect the roofing material and the further roofing material and improve precision of the connection, and also it becomes easy to form a roof having a high water barrier property (waterproof property).

Further, the roof structure in accordance with the present invention is formed by connecting the above roofing materials. Therefore, the roof structure can be formed easily and has a high water barrier property.

DETAILED DESCRIPTION

The following explanations are made to embodiments of the present invention.

Figure 1A:
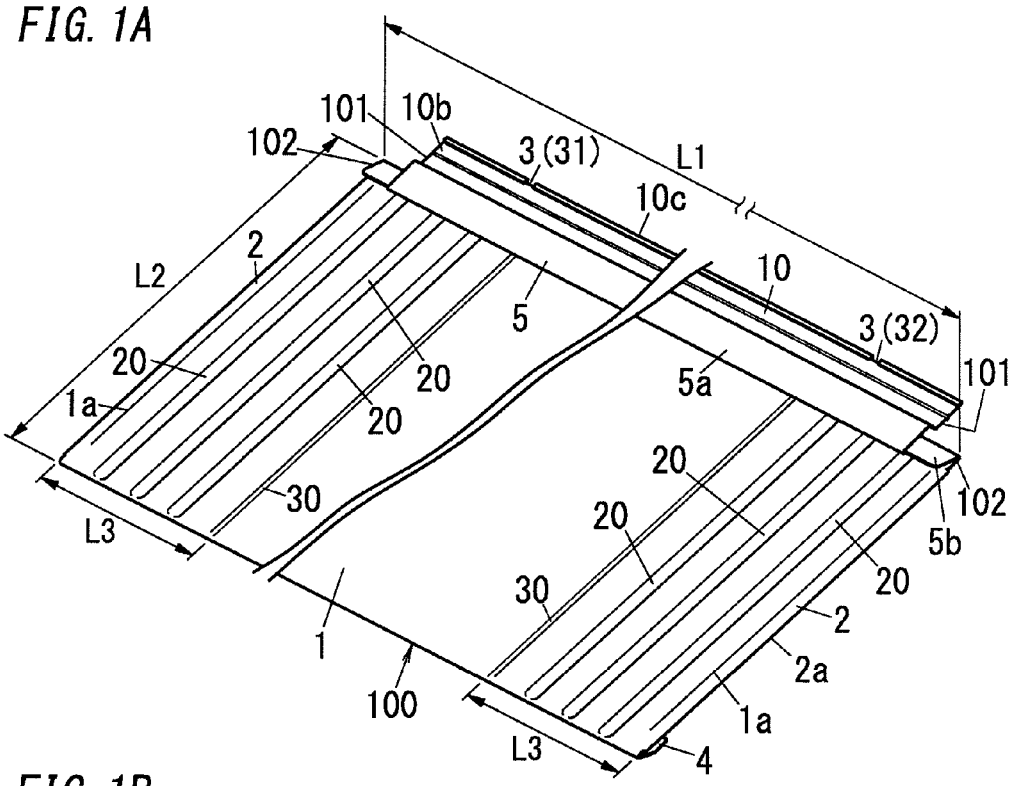
FIG. 1A is a perspective view illustrating an example of the roofing material according to the embodiment of the present invention.
Figure 1B:
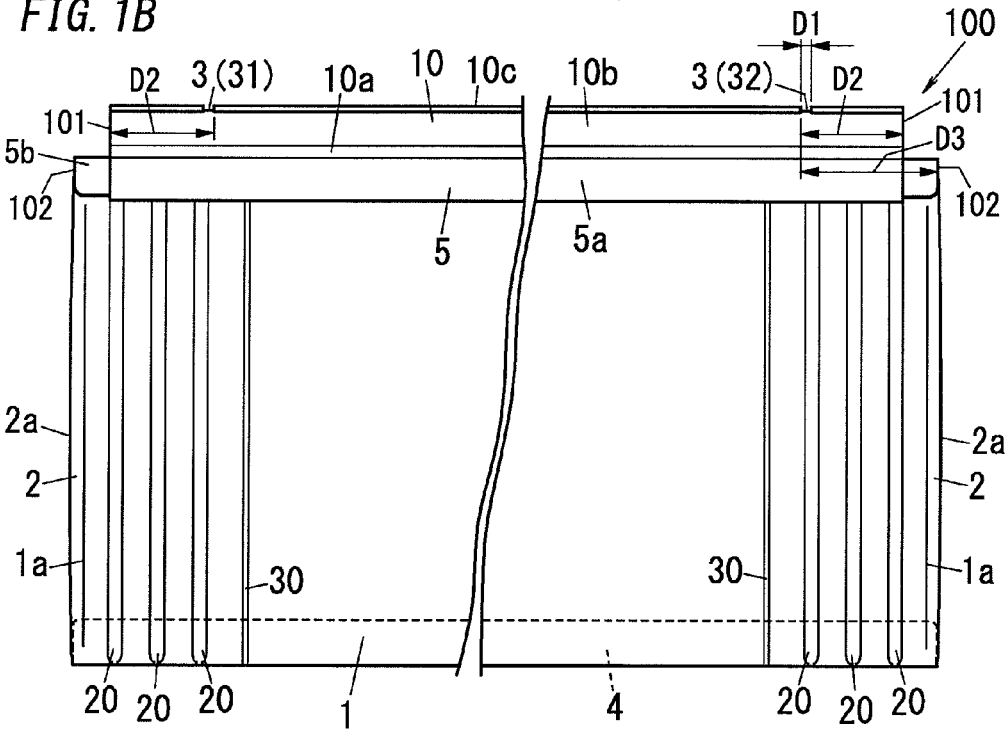
FIG. 1B is a plan view illustrating the example of the roofing material according to the embodiment of the present invention.
Figure 2A:
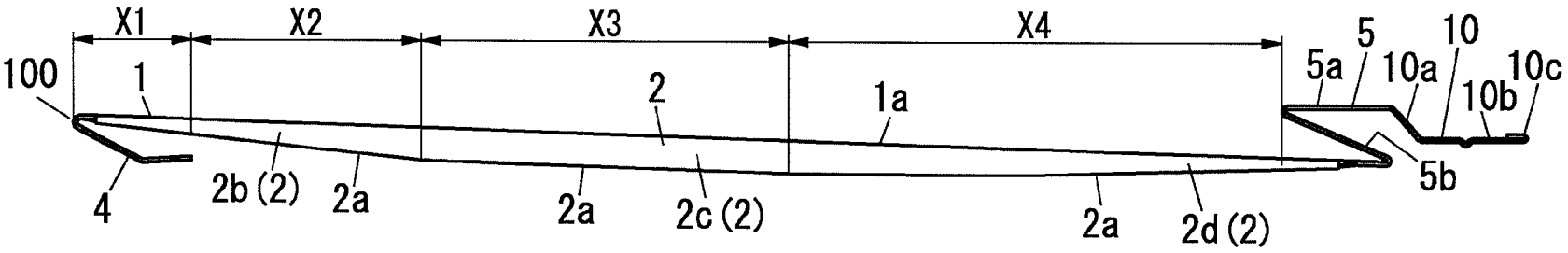
FIG. 2A is a side view illustrating the example of the roofing material according to the embodiment of the present invention.
Figure 2B:
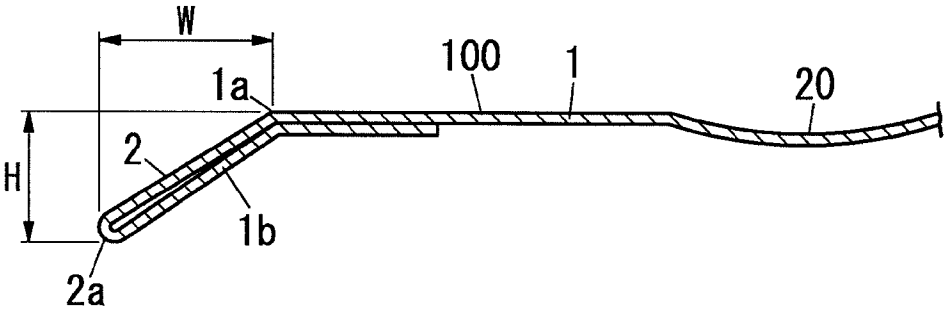
FIG. 2B is a sectional view illustrating a side end of the example of the roofing material according to the embodiment of the present invention.

FIGS. 1A, 1B, 2A and 2B each show an example of the roofing material 100 of one embodiment in accordance with the present invention. FIG. 1A is a perspective view of the roofing material 100 and FIG. 1B is a plan view of the roofing material 100. In the figures, a central portion of the roofing material 100 is partially omitted. FIG. 2A is a side view of the roofing material 100 and FIG. 2B is a partial sectional view of a side end of the roofing material 100. The following explanations referring to FIGS. 1A, 1B, 2A and 2B are made to the roofing material 100 of the present embodiment.

As shown in FIG. 1, the roofing material 100 of the present embodiment includes a main body 1, two fitting parts 4 and 5, two inclined pieces 2 and two positioning markers 3. The main body 1 is formed into a substantially flat plate shape. In the present embodiment, the main body 1 is substantially rectangular and has long sides and short sides. The two fitting parts 4 and 5 are individually situated at the long sides of the main body 1. Hereinafter, as necessary, the fitting part 4 and the fitting part 5 are referred to as "first fitting part 4" and "second fitting part 5", respectively. Further, as shown in FIGS. 1A, 1B and 2A, the two inclined pieces 2 are individually situated at the short sides of the main body 1. Note that FIG. 2A is a side view of the roofing material when viewed from the short side (inclined piece 2) of the main body 1.

The first fitting part 4 is formed by bending an end part extending from the long side of the main body 1 towards the rear side of the main body 1 (see FIG. 2A). The first fitting part 4 is formed to extend the almost entire length of the lengthwise direction of the main body 1.

The second fitting part 5 is constituted by an upper piece 5*a*, a lower piece 5*b* and a fixed piece 10. As shown in FIG. 2A, the lower piece a is formed by bending an end part extending from the end of the main body 1 towards the front surface of the main body 1 so as to be substantially flat and extend the almost entire length in the lengthwise direction of the main body 1. The upper piece 5*a* protrudes from an end of the lower piece 5*b* away from the main body 1. The upper piece 5*a* is also substantially flat. The second fitting part 5 includes the upper piece 5*a* and the lower piece 5*b* as mentioned above, and thus the second fitting part 5 protrudes in a direction in which the front surface of the main body 1 is directed. In the present embodiment, the upper piece 5*a* does not extend close to the both ends of the lower piece 5*b*. In summary, the upper piece 5*a* does not extend the entire length of the lower piece 5*b* and is shorter in entire length than the lower piece 5*b*.

As shown in FIG. 2A, the fixed piece 10 protrudes from an end of the upper piece 5*a* away from the roofing material 100 and is formed so as to extend the entire length of the upper piece 5*a*. In the roofing material 100 of the present embodiment, the fixed piece 10*c* includes an inclined part 10*a* and a fixed part 10*b*, and is formed into a substantially L shape. The inclined part 10*a* is formed so as to extend from an end of the upper piece 5*a* and be inclined downward (i.e. towards the rear side of the roofing material 100). Further, the fixed piece 10 is bent at the end of the inclined part 10*a* so that the fixed part 10*b* is substantially parallel to the main body 1. The fixed part 10*b* is positioned at a different level from the main body 1, and is positioned above the main body 1. As shown in FIGS. 2A and 2B, the long side of the fixed part 10*b* is bent towards the front surface, and as a result, the end part of the fixed part 10*b* is double-folded. The positioning marker 3 may be formed in the fixed piece 10. In the roofing material 100 of the present embodiment, the long side of the fixed part 10*b* is partially cut out to leave a cut-out and the cut-out serves as the positioning marker 3. The positioning marker 3 may be formed into various shapes such as a rectangular shape (U shape), a triangular shape (V shape), a linear shape and a circular shape in a plan view (when viewed from above).

Figure 3A:
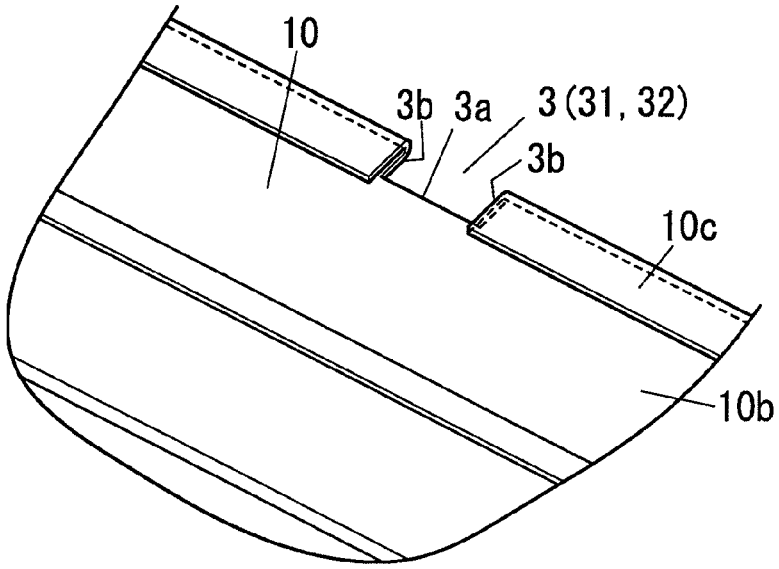
FIG. 3A is a partial perspective view illustrating the example of the roofing material according to the embodiment of the present invention.

FIG. 3A shows an example in which the positioning marker 3 is formed into a rectangular cut-out. There is a double-folded part 10*c* which defines the long side of the fixed piece 10 and extends the entire length of the fixed piece 10. The double-folded part 10*c* is formed by bending a metal plate at 180 degrees (i.e., hemming). The positioning marker 3 penetrates the double-folded part 10*c* in a thickness direction. In a plan view, the positioning marker 3 has a periphery constituted by a long side 3*a* parallel to the long side of the fixed piece 10 and two short sides 3*b* perpendicular to the long side 3*a*. The positioning marker 3 is opened at the long side of the fixed piece 10.

Figure 3B:
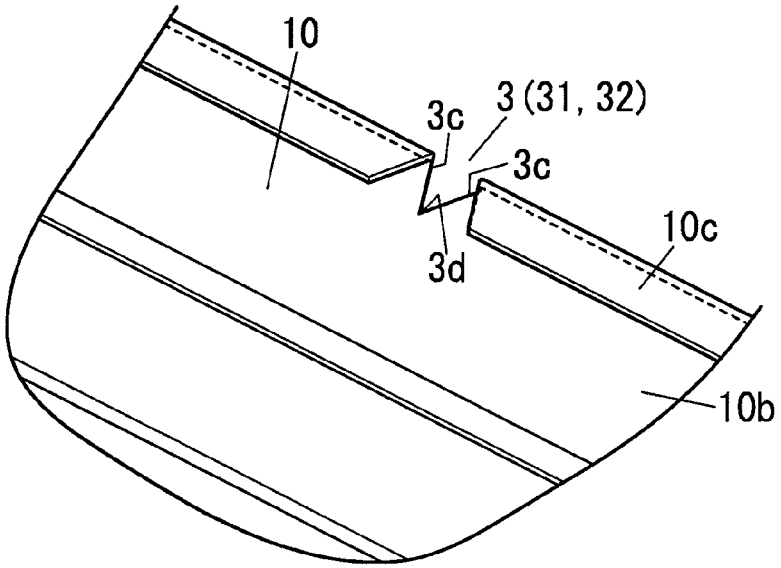
FIG. 3B is a partial perspective view illustrating a further example of the roofing material according to the embodiment of the present invention.

FIG. 3B shows another case in which the positioning marker 3 is formed into a triangular cut-out. As in the above case, the double-folded part 10*c* defines the long side of the fixed piece 10 and extends the entire length of the fixed piece 10. The positioning marker 3 penetrates the double-folded part 10*c* in a thickness direction. The positioning marker 3 has a periphery constituted by two inclined sides 3*c* inclined with respect to the lengthwise direction of the fixed piece 10. The positioning marker 3 is opened at the long side of the fixed piece 10.

Two or more positioning markers 3 may be formed. As shown in FIGS. 1A and 1B, in the present embodiment, two positioning markers 3 and 3 are formed. Hereinafter, one of the two positioning markers 3 and 3 is referred to as a first positioning marker 31 and the other is referred to as a second positioning marker 32.

In the roofing material 100 of the present embodiment, the positioning marker 3 is formed by cutting, but may be formed by a different method. For example, the positioning marker 3 may be a marking formed on a predetermined part of the roofing material 100 with ink, paint or the like. However, as mentioned below, in view of productivity, it is preferable that the positioning marker 3 be formed by cutting.

In a case where the positioning marker 3 is formed into a rectangular cut-out as in the case of the roofing material 100 shown in FIGS. 1A and 1B, the width (distance between opposite short sides 3*b*) D1 may be approximately 6 mm, but not limited thereto. In a case where the positioning marker 3 is formed into a triangular cut-out, the width (size of opening part of the positioning marker 3) D1 may be approximately 6 mm, but not limited thereto.

In a plan view, in a case where a dimension of an overlap of the adjacent roofing materials 100 is 100 mm, the distance D2 between the positioning marker 3 and a side end (short side) 101 of the fixed piece 10 may be 56 mm to 66 mm. Further, in a plan view, the distance D3 between the positioning marker 3 and a side end (short side) 102 of the second fitting part 5 may be 76 mm to 86 mm. When the positioning marker 3 is a rectangular cut-out, the distance D2 is defined as the distance between the side end (short side) 101 of the fixed piece 10 and the short side 3*b* of the positioning marker 3 which is one of the short sides closer to the center of the roofing material 100 in the lengthwise direction than the other. When the positioning marker 3 is a rectangular cut-out, the distance D3 is defined as the distance between the side end 102 of the second fitting part 5 and the short side 3*b* of the positioning marker 3 which is one of the short sides 3*b* closer to the center of the roofing material 100 in the lengthwise direction than the other. When the positioning marker 3 is a triangular cut-out, the distance D2 is defined as the distance between the side end 101 of the fixed piece 10 and a vertex (point where the two inclined sides 3*c* meet) 3*d* of the positioning marker 3. When the positioning marker 3 is a triangular cut-out, the distance D3 is defined as the distance between the side end 102 of the second fitting part 5 and the vertex (point where the two inclined sides 3*c* meet) 3*d* of the positioning marker 3. Each inclined piece 2 is formed to extend the substantially entire length of the short side of the main body 1. As shown in FIGS. 2A and 2B, each inclined piece 2 is an end part which extends from the end of the main body 1 and is bent so as to be inclined downward. Note that FIG. 2B is a sectional view of the side end of the roofing material 100 in the lengthwise direction of the roofing material 100.

The inclined piece 2 includes sections individually defining a front part 2*b*, a middle part 2*c* and a rear part 2*d*. In detail, the front part 2*b* is defined as a section of the inclined pieces 2 which is closest to the first fitting part 4 and the rear part 2*d* is defined as another section of the inclined pieces 2 which is closest to the second fitting part 5. The middle part 2*c* is defined as a section between the front part 2*b* and the rear part 2*d*.

The angle (minor angle here) between the main body 1 and each inclined piece 2 may be 120 degree to 150 degree, for example. In more detail, the angle between the middle part 2*c* and the main body 1 may be approximately 120 degree, the angle between the rear part 2*d* and the main body 1 may be approximately 140 degree, and the angle between the front part 2*b* and the main body 1 may be approximately 140 degree. In this case, the middle part 2*c* is greater in bend height H, which is described later, than the front part 2*b* and the rear part 2*d*.

The front part 2*b* is formed such that the bend height H becomes greater towards an end close to the middle part 2*c* than at an end far from the middle part 2*c*. Note that, as shown in FIG. 2B, the bend height H is defined as the distance between the plane of the main body 1 and the imaginary plane which includes the end (referred to as "inclined piece end 2*a*" hereinafter) of the inclined pieces 2 and is parallel to the main body 1. The middle part 2*c* is formed so that the bend height H is kept substantially constant over the entire length of the middle part 2*c*. In other words, a part of a side end 1*a* connected to the section defining the middle part 2*c* is formed so as to be substantially parallel to the inclined piece end 2*a*. Further, the rear part 2*d* is formed such that the bend height H becomes greater towards an end close to the middle part 2*c* than at an end far from the middle part 2*c*.

The inclined piece end 2*a* of the section defining the front part 2*b* may be linear or curved. In contrast, it is preferable that the inclined piece end 2*a* of the section defining the middle part 2*c* is formed to be linear. Further, the inclined piece end 2*a* of the section defining the rear part 2*d* may be linear or curved as in the case of the inclined piece end 2*a* of the section defining the front part 2*b*. In a case where the inclined piece end 2*a* of the section defining the rear part 2*d* is linear, the inclined piece end 2*a* may be bent at the substantially middle point of the inclined piece end 2*a*. The inclined piece ends 2*a* of the sections defining the front part 2*b*, the middle part 2*c* and the rear part 2*d* are formed in the above described manner, and thereby the inclined piece 2 protrudes downward from the roofing material 100 and curves outward. Note that the phrase "protrude downward and curve outward" means projecting (protruding) downward to have a curved outline.

The bend height H of the middle part 2*c* may be, for example, 3 mm to 7 mm, and may preferably be approximately 5 mm. When the inclined piece end 2*a* of the front part 2*b* is curved, a curvature radius thereof may be 300 mm to 500 mm, and may preferably be approximately 400 mm. Further, when the inclined piece end 2*a* of the rear part 2*d* is curved, a curvature radius thereof may be 1000 mm to 1500 mm, and may preferably be approximately 1200 mm. In this case, as mentioned below, it is possible to suppress formation of an interspace between parts to be overlapped of the adjacent roofing materials 100 and 100.

The width W of each inclined piece 2 may be in a range of 4 mm to 9 mm over the entire length of the inclined pieces 2, and preferably the widths W of the middle part 2*c*, the rear part 2*d* and the front part 2*b* may be 6 mm, 7 mm and 7 mm, respectively. Note that, as shown in FIG. 2B, the width W herein is defined as the distance of the side end la from the imaginary plane which includes the inclined piece end 2*a* and is perpendicular to the main body 1.

The length of a part of the side end 1*a* connected to the section defining the front part 2*b* may be 40 mm to 60 mm, and preferably may be 40 mm. The length of a part of the side end 1*a* connected to the section defining the middle part 2*c* may be 50 mm to 100 mm, and preferably may be 60 mm. The length of a part of the side end 1*a* connected to the section defining the rear part 2*d* may be 80 mm to 120 mm, and preferably may be 100 mm.

In a case where the length L2 of the main body 1 in the width direction is 251 mm and X1, X2, X3, and X4 of FIG. 2A are 20 mm, 40 mm, 60 mm, and 100 mm, respectively, the bend height H at a point of the front part 2*b* at a distance of 40 mm from the middle part 2*c* may be 3 mm, the bend height H at the middle part 2*c* may be 6 mm and the bend height H at a point of the rear part 2*d* at a distance of 100 mm from the middle part 2*c* may be 3 mm. In this case, as described later, it is easy to prevent the formation of a gap between the inclined piece end 2*a* of an upper one of the adjacent two roofing materials 100 and 100 and the main body 1 of a lower one of the adjacent two roofing materials 100 and 100.

As shown in FIG. 2B, the inclined pieces 2 each may be provided with, as a reinforcing piece 1*b*, a folded-back part formed by bending the main body so that the side end is close to the rear surface. In this case, both the inclined piece 2 and the side end of the main body 1 have a double-folded structure and thereby rigidity of end parts of the roofing material 100 can be improved.

As shown in FIG. 1, the main body 1 may be provided with at least one protrusion part 20. In the roofing material 100 of the present embodiment, the protrusion part 20 is formed to protrude in a direction in which the rear surface of the main body 1 is directed. The protrusion part 20 is formed so as to extend the substantially entire length of the main body 1 in a direction from the first fitting part 4 toward the second fitting part 5 and be substantially parallel to the short sides of the main body 1. Further, the protrusion part 20 can be formed with, for example, a substantially U shape groove or a substantially V shape groove which opens in the front surface of the main body 1. As seen in the present embodiment, a plurality of protrusion parts 20 may be formed. In this case, the plurality of protrusion parts 20 may be formed on both side parts corresponding to the short sides of the main body 1. In the roofing material 100 shown in FIGS. 1A and 1B, the numbers of protrusion parts 20 formed on the both sides are same. As a matter of course, the numbers of protrusion parts 20 formed on the both sides may be different. The protrusion part 20 can be formed on the surface of the main body 1 by ribbing. Note that the protrusion part 20 may protrude in a direction in which the front surface of the main body 1 is directed, i.e. upward from the main body 1. Also, both of the protrusion part 20 protruding from the front surface of the main body 1 and the protrusion part 20 protruding from the rear surface of the main body 1 may be formed.

The protrusion part 20 can be formed, for example, such that the width thereof is in a range of 4 mm to 10 mm, the depth thereof from the surface of the main body 1 is in a range of 0.5 mm to 1.5 mm, and the length thereof is 180 mm to 280 mm. Further, it is preferable that the protrusion part 20 is formed such that the distance (L3 in FIG. 1A) from the inclined piece end 2*a* is in a range of 100 mm to 200 mm.

The main body 1 may include at least one position checking part 30. The position checking part 30 is formed, for example, so as to protrude in a direction in which the front surface of the main body 1 is directed and extend the almost entire length of the main body 1 in a direction from the first fitting part 4 toward the second fitting part 5. Further, one position checking part 30 or a plurality of position checking parts 30 may be formed on each of the opposite sides of the main body 1. In either case, the position checking part 30 can be formed at the position which is 100 mm apart from the inclined piece end 2*a*. In a case where the plurality of position checking parts 30 are provided to each of the opposite sides of the main body 1, the plurality of position checking parts 30 can be arranged at a regular interval from the inclined piece end 2*a*. For example, the position checking parts 30 can be arranged at intervals of 100 mm from the inclined piece end 2*a*. The position checking part 30 can be formed, by ribbing or the like, for example, so as to leave a recess open to the rear surface of the main body 1. The position checking part 30 may have a substantially V shape or a substantially U shape in a sectional view.

The length L1 of the roofing material 100 in the lengthwise direction can be set, for example, to a basic length of approximately 2000 mm, but not limited thereto. The length L2 of the roofing material 100 in the width direction can be set, for example, to 200 mm to 280 mm, and preferably can be set to approximately 250 mm.

The roofing material 100 may be formed into a bilaterally symmetric shape. In other words, the roofing material 100 may be formed so as to be symmetry with respect to a line which divides the roofing material 100 into two left and right equal parts. Note that the left and right direction herein is a direction same as the lengthwise direction of the roofing material 100. When the roofing material 100 is formed into a bilaterally symmetric shape, as mentioned below, the roofing material 100 can be installed from either of left and right sides of the roof.

The roofing material 100 can be formed into an intended shape by processing a metal plate by a roll forming process or the like. Examples of the metal plate include a steel sheet, a zinc-plated steel plate and a galvalume (registered trademark) steel sheet, and a front surface and a rear surface of any of the examples of the metal plate may be coated. The thickness of the metal plate may be, for example, in a range of 0.3 mm to 0.5 mm and the weight per area thereof may be, for example, in a range of 4.0 kg/m$^2$ to 5.0 kg/m$^2$.

The roofing material 100 is generally manufactured with a roll former. However, in a case where the roofing material 100 has few parts to be subjected to an R process (curving process) as in the present embodiment, the roofing material 100 can be manufactured with a bending processor. The end of the roofing material 100 can be formed by hemming and pressing.

In a case where the positioning marker 3 is formed by cutting, the metal plate may be subjected to cutting to form the positioning marker 3 in advance and then bent, or the metal plate may be bent and then subjected to the above cutting. In view of facilitating manufacture and being capable of continuous manufacture, it is preferable that the metal plate is subjected to cutting in advance (also referred to as pre-cutting) and then bent.

Figure 4A:
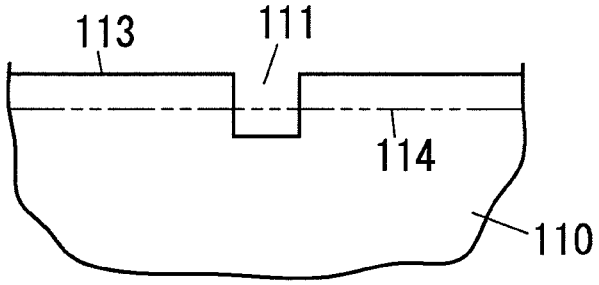
FIG. 4A is a partial plan view illustrating the example of the roofing material according to the embodiment of the present invention.
Figure 4B:
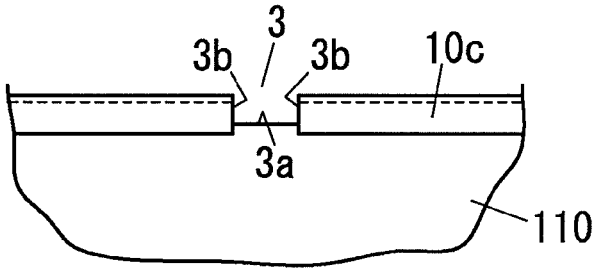
FIG. 4B is a partial plan view illustrating the example of the roofing material according to the embodiment of the present invention.

In a case where the positioning marker 3 is constituted by a rectangular cut-out, the first step is, as shown in FIG. 4A, to make a substantially U-shaped cut 111 in an end of a metal plate 110 which is to serve as the fixed piece 10. The cut 111 is formed in an end edge 113 of the metal plate 110 so as to open outward. The next step is, as shown in FIG. 4B, to form the double-folded part 10*c* by bending the metal plate 110 along a bending line 114 parallel to the end edge 113 by hemming so that the end of the metal plate 110 overlaps the front surface. The bending line 114 is imaginarily set so as to pass through a point which is at a distance of the almost half of the depth of the cut 111 from the end edge 113. As a result of formation of the double-folded part 10*c* by almost half bending, the cut 111 is left as the positioning marker 3 constituted by the rectangular cutout.

Figure 5A:
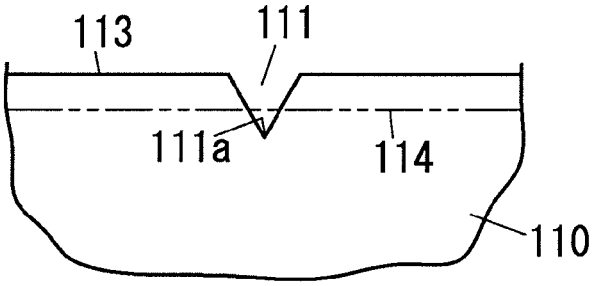
FIG. 5A is a partial plan view illustrating the further example of the roofing material according to the embodiment of the present invention.
Figure 5B:
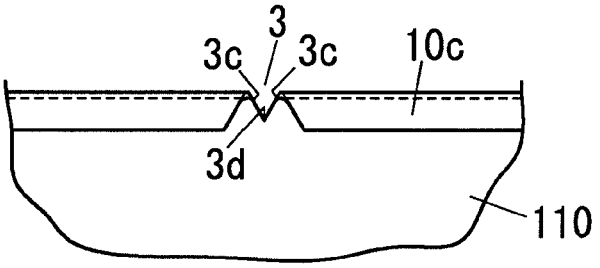
FIG. 5B is a partial plan view illustrating the further example of the roofing material according to the embodiment of the present invention.

In a case where the positioning marker 3 is constituted by a triangular cut-out, the first step is, as shown in FIG. 5A, to make a V-shaped cut 111 in the end of the metal plate 110 which is to serve as the fixed piece 10. The cut 111 is formed in the end edge 113 of the metal plate 110 so as to open outward. The next step is, as shown in FIG. 5B, to form the double-folded part 10*c* by bending the metal plate 110 along the bending line 114 parallel to the end edge 113 by hemming so that the end of the metal plate 110 overlaps the front surface. The bending line 114 is imaginarily set so as to pass through a point which is at a distance of the almost half of the depth of the cut 111 which is a length from the end edge 113 to a vertex 111*a* (identical with the vertex 3*d* of the positioning marker 3) of the cut 111. As a result of formation of the double-folded part 10*c* by almost half bending, the cut 111 is left as the positioning marker 3 constituted by the above triangular cutout.

It is possible to form a roof by placing a plurality of roofing materials 100 on a sheathing roof board or the like which serves as a roof base. Placing the roofing material 100 on the roof base is also described as installing the roofing material 100. In the process of installing the roofing material 100 of the present embodiment, the first fitting part 4 is placed so as to be directed to a downward side of the inclined surface of the roof, and the second fitting part 5 is placed so as to be directed to an upward side of the inclined surface of the roof. When the roofing material 100 is installed in such a manner, the fixed piece 10 is the closest part to the upward side in the roofing material 100. The above downward side can be described as "eave side of the roof" or "downstream side of the roof". Further, the above upward side can be described as "ridge side of the roof" or "upstream side of the roof". Note that a direction interconnecting the downward side and the upward side is referred to as "inclining direction" hereinafter.

Installation of the roofing materials 100 can be performed by preparing the plurality of roofing materials 100, and installing the plurality of roofing materials 100 sequentially from the downward side to the upward side. The adjacent roofing materials 100 in a direction perpendicular to the inclining direction on the roof base are connected to each other under a condition that the inclined piece 2 of one of the adjacent roofing materials 100 is placed on the surface of the main body 1 of the other one of the adjacent roofing materials 100.

Figure 6A:
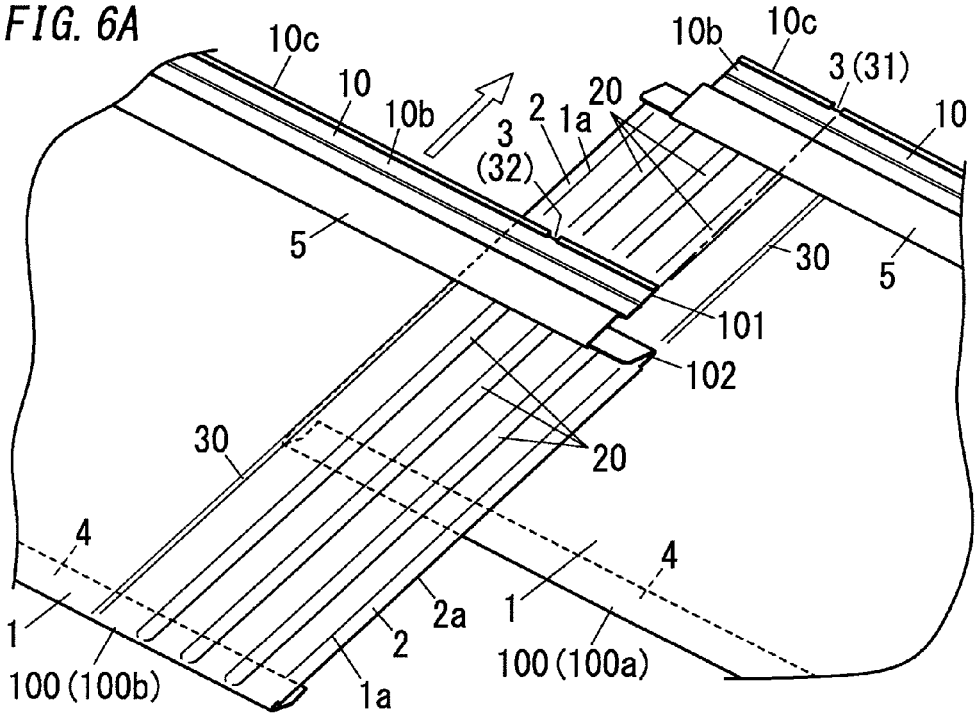
FIG. 6A relates to explanation about installation of the roofing material according to the present invention, and shows a partial perspective view explaining about how to connect the adjacent roofing materials to each other.
Figure 6B:
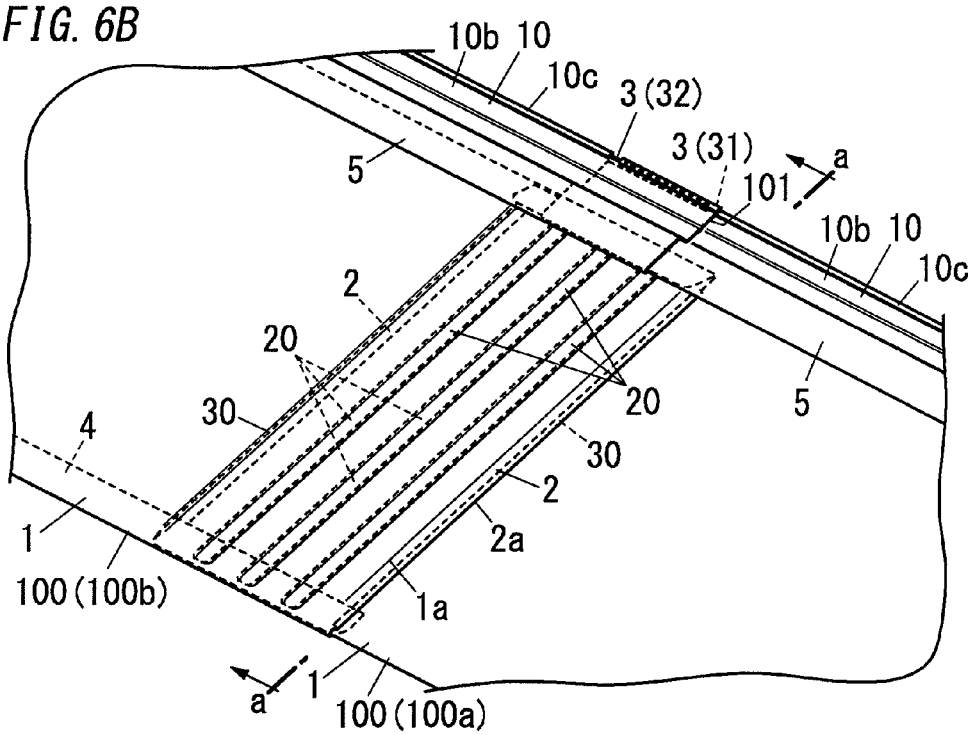
FIG. 6B relates to explanation about installation of the roofing material according to the present invention, and shows a partial perspective view illustrating the structure in which the adjacent roofing materials are connected to each other.

FIGS. 6A and 6B show a mechanism of interconnection of the roofing materials 100 and 100 adjacent to each other in the direction perpendicular to the inclining direction. FIG. 6A is a perspective view explaining about how to connect the adjacent roofing materials to each other, and FIG. 6B is a partial perspective view illustrating the structure in which the adjacent roofing materials are connected to each other. Note that, in FIG. 6A, a lower one of the adjacent roofing materials 100 and 100 is referred to as a roofing material 100*a* and an upper one is referred to as a roofing material 100*b*. In the following explanations, the adjacent roofing materials 100 are described in such a manner, as necessary. In order to connect the roofing materials 100*a* and 100*b* adjacent to each other in the direction perpendicular to the inclining direction, first, the roofing material 100*a* is installed and next the side end of the roofing material 100*b* is overlapped with the side end of the preliminarily-placed roofing material 100*a*. In overlapping the roofing material 100*a* and the roofing material 100*b*, it is necessary to position the roofing material 100*a* and the roofing material 100*b* by adjusting an overlap dimension that is a length of an overlap between the roofing materials 100*a* and 100*b*. Such positioning may be performed with reference to the positioning marker 3. Specifically, as indicated by a dashed-dotted line in FIG. 6A, the roofing material 100*a* and the roofing material 100*b* are arranged such that the side end 101 of the fixed piece 10 of the roofing material 100*b* and the positioning marker 3 of the preliminarily-placed roofing material 100*a* are substantially on the same straight line along the inclining direction of the roof.

Figure 7A:
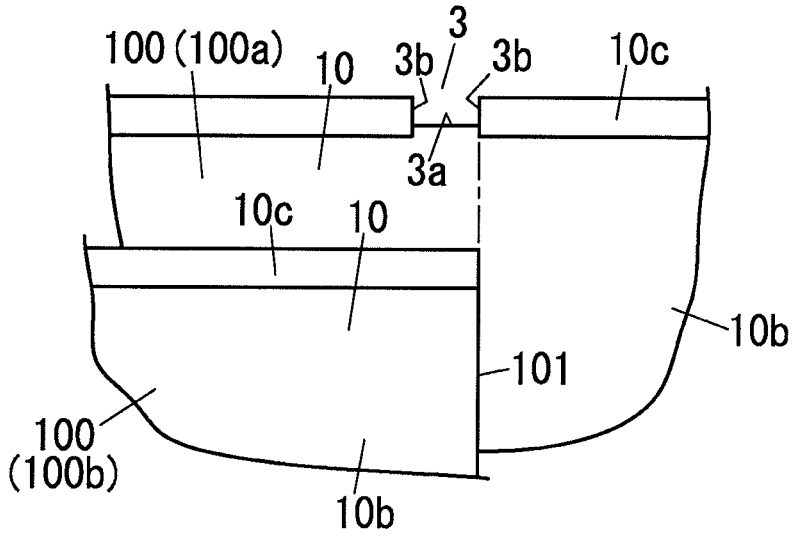
FIG. 7A is a partial plan view for explanation about installation of the above roofing material.
Figure 7B:
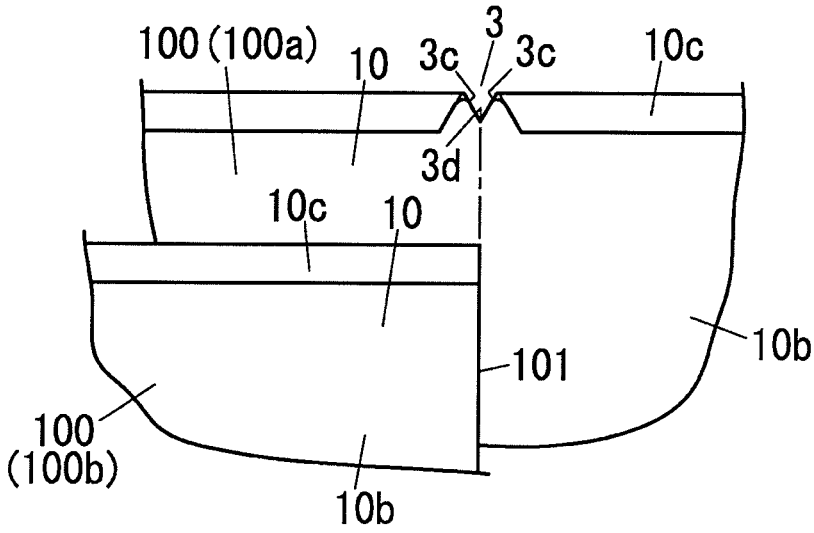
FIG. 7B is a partial plan view for explanation about the installation of the above roofing material.

In a case where the positioning marker 3 is constituted by a rectangular cut-out, as shown in FIG. 7A, the roofing materials 100*a* and 100*b* are positioned such that the side end 101 of the fixed piece 10 of the roofing material 100*b* and the side end (one short side 3*b*) of the positioning marker 3 of the preliminarily-placed roofing material 100*a* are on the same straight line along the inclining direction of the roof. In a case where the positioning marker 3 is constituted by a triangular cut-out, as shown in FIG. 7B, the roofing materials 100*a* and 100*b* are positioned such that the side end 101 of the fixed piece 10 of the roofing material 100*b* and the pointed vertex 3*d* of the positioning marker 3 of the preliminarily-placed roofing material 100*a* are on the same straight line along the inclining direction of the roof. In some cases, positioning with reference to the point corresponding to the pointed vertex 3*d* of the positioning marker 3 constituted by the triangular cut-out may be easier than positioning with reference to the line corresponding to the short side 3*b* of the positioning marker 3 constituted by the rectangular cut-out.

As shown in FIG. 6A, the roofing material 100*b* is moved in the direction of the arrow shown in the figure such that the upper piece 5*a* and the lower piece 5*b* of the roofing material 100*b* are placed on the upper piece 5*a* and the lower piece 5*b* of the roofing material 100*a*, respectively. It is sufficient that the second fitting parts 5 of the respective roofing materials 100*a* and 100*b* are overlapped such that the second fitting part 5 of the roofing material 100*a* is held between the rear surfaces of the second fitting part 5 of the roofing material 100*b*. The roofing material 100*b* is placed on the roofing material 100*a* while the roofing material 100*b* is positioned as described above and, thereby, as shown in FIG. 6B, the respective sides of the roofing materials 100*a* and 100*b* are overlapped with each other and connected to each other. Further, the entire positioning marker 3 of the preliminarily-placed roofing material 100*a* is concealed by the fixed piece 10 of the roofing material 100*b* and thus cannot be seen from the front side.

The roofing material 100 can be installed with reference to the positioning marker 3 as mentioned above and therefore it is possible to easily perform positioning for connection of the roofing materials 100*a* and 100*b*. As a result, it is possible to smoothly install the roofing materials 100 and increase precision of the installation. Further, the almost entire positioning marker 3 is concealed by the fixed piece 10 and thus is not likely to be seen from the front side, and as a result, the appearance of the roof does not become poor.

Further, the positioning marker 3 is formed at a predetermined distance from the side end of the roofing material 100. Therefore, when the two roofing materials 100 are connected with reference to the positioning marker 3, it is possible to obtain a sufficient dimension of an overlap therebetween. Thereby, it is possible to form a roof with a high water barrier property. When the overlap is short, rainwater may reach the base such as the sheathing roof board by passing through the gap between the roofing materials 100*a* and 100*b*, and therefore leaking of rain may occur. However, by keeping a sufficient dimension of the overlap, it becomes easy to suppress intrusion of rainwater into the base. This is because, when the overlap is long, rainwater is drained out through the below described drainage space formed between the roofing materials 100*a* and 100*b* adjacent to each other before reaching the base.

In order to adjust the dimension of the overlap to a dimension sufficient for ensuring a water barrier property, as shown in FIGS. 6A and 6B, it is sufficient to place the side end 101 of the fixed piece 10 of the roofing material 100*b* and the positioning marker 3 of the preliminarily-placed roofing material 100*a* on the straight line as mentioned above. As a matter of course, to increase the dimension of the overlap, the side end 101 of the fixed piece 10 of the roofing material 100*b* may be situated closer to the center of the roofing material 100*b* than the positioning marker 3 is. In this case, the water barrier property (waterproof property) of the roof is further improved. The dimension of the overlap necessary for keeping a high water barrier property depends on a size and the like of the roofing materials. For example, in the case of the roofing material 100 having the configuration shown in FIGS. 1A and 1B, it is preferable that the dimension of the overlap is equal to or more than 80 mm, and it is more preferable that the dimension of the overlap is equal to or more than 100 mm. In view of workability and economic performance, it is preferable that the maximum value of the dimension of the overlap is a half of the length (L1 in FIG. 1A) of the roofing material 100 in the lengthwise direction.

Even when the positioning marker 3 is constituted by a cut-out, the waterproof property of the roofing material 100 itself is sufficient providing that the positioning marker 3 is formed not in the main body 1, but in the end of the fixed piece 10, as the case of the roofing material 100 having the configuration shown in FIGS. 1A and 1B.

Further, as in the case of the roofing material 100 having the configuration shown in FIGS. 1A and 1B, the roofing material 100 may include the first positioning marker 31 and the second positioning marker 32 so that the distance D3 of the first positioning marker 31 from the side end 102 of the fitting part 5 is substantially equal to the distance D3 of the second positioning marker 32 from the side end 102 of the fitting part 5. In this case, any one of the adjacent two roofing materials 100*a* and 100*b* can be placed on the other. In brief, in this case, the roofing material 100 can be installed either from the left side or from the right side. Therefore, although in FIGS. 6A and 6B the roofing material 100*a* is first installed and next the roofing material 100*b* is installed, in contrast the roofing material 100*b* can be first installed, and next the roofing material 100*a* can be installed on the side of the front surface of the roofing material 100*b*. As a matter of course, also in this case, the roofing material 100*a* can be installed while the positioning is performed with reference to the positioning marker 3. Also, in a case where the roofing material 100 is formed into a bilaterally symmetric shape, the roofing material 100 can be installed either from the left side or from the right side as in the above case and thereby the workability can be further improved.

Figure 8:
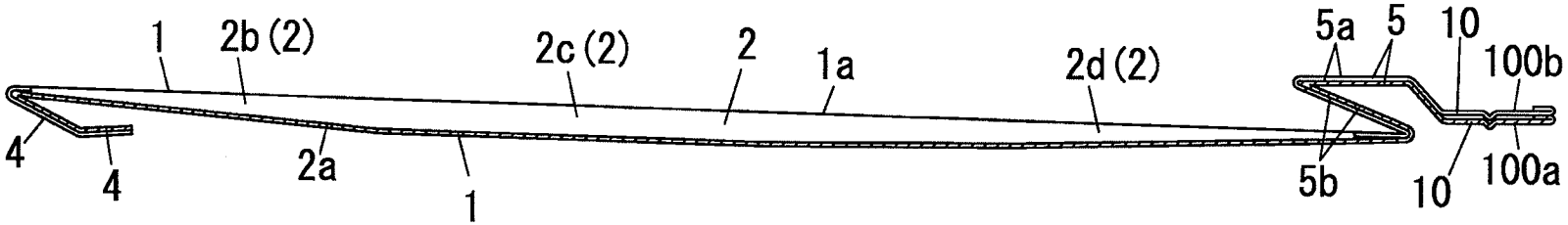
FIG. 8 relates to explanation about installation of the roofing material according to the present invention, and shows a sectional view illustrating the structure in which the adjacent roofing materials are connected to each other.

FIG. 8 shows a cross-section taken along the inclining direction of the structure in which the roofing material 100*a* and the roofing material 100*b* are connected to each other. In detail, FIG. 8 is a sectional view taken along the line a-a in FIG. 6B and shows a section, taken along the side end of the roofing material 100*b*, of the above structure. When the two roofing materials 100 are overlapped each other as described above, the inclined piece end 2*a* of the upper roofing material 100*b* is in contact with the front surface of the main body 1 of the lower roofing material 100*a* over the almost entire length of the lower roofing material 100*a* in the lengthwise direction. Generally, when the roofing material 100 is placed on the base, the roofing material 100 is likely to warp due to the weight of the roofing material 100 or stress produced by workers walking during installation. Hence, the roofing material 100 may have a shape which curves relative to the inclining direction and protrudes in a direction in which the rear surface is directed. However, as mentioned above, the inclined piece end 2*a* also protrudes downward and curves outward, and therefore, as shown in FIG. 8, the inclined piece end 2*a* of the upper roofing material 100*b* fits the surface of the main body 1 of the lower roofing material 100*a* which curves relative to the inclining direction and protrudes in a direction in which the rear surface is directed. As a result, the inclined piece end 2*a* of the upper roofing material 100*b* and the main body 1 of the lower roofing material 100*a* are in close contact with each other, and it is possible to easily suppress formation of space therebetween. Thereby, it becomes easy to suppress intrusion of rainwater and the like into the overlap between the roofing materials 100 and 100 adjacent to each other in the lateral direction.

The degree of bend of the roofing material 100 is constant, irrespective of the size of the roofing material 100. Therefore, even when the roofing material 100 is formed to have any size, the inclined piece end 2*a* of the roofing material 100 can fit the bend. In the past, the roofing material 100 has been reinforced by use of thermal insulation material such as polyurethane and polystyrene. However, it is not necessary to reinforce the roofing material 100 of the present embodiment by bonding such thermal insulation material to the roofing material 100 or the like. Therefore, it is possible to achieve weight saving of the whole roof, facilitation of installation and cost reduction as well. Further, an unwanted space is unlikely to occur between the inclined piece end 2*a* of the upper roofing material 100 and the main body 1 of the lower roofing material 100 and therefore it is possible to suppress formation of shadow caused by such a space. Consequently, the whole appearance of the roof is likely to be sufficient and a roof with attractive appearance can be formed.

Note that when the roofing materials 100 are overlapped each other so that the dimension of the overlap is in a range of 100 mm to a half of the length of the roofing material 100 in the lengthwise direction, inclusive, the inclined piece end 2*a* of the roofing material 100 can fit the bend. Further, in a case where the position checking part 30 is provided to the roofing material 100, when the roofing materials 100 adjacent in a direction perpendicular to the inclining direction are overlapped each other, it is possible to check whether the dimension of the overlap is sufficient for ensuring the water barrier property. Therefore, by forming the position checking part 30 as well as the positioning marker 3, it is possible to check the installation position of the roofing materials 100 based on double criteria. In detail, the inclined piece end 2*a* at the end in the lengthwise direction of the roofing material 100 is subjected to three-dimensional curving process with regard to the width direction, and thus has a curved outline. Particularly, the middle part 2*c* is larger in a bending angle than the front part 2*b* and the rear part 2*d*, and thus is shorter in the lengthwise direction of the roofing material 100 by about 1 to 2 mm than the front part 2*b* and the rear part 2*d*. Therefore, when the positioning is done by placing the end of the front part 2*b* or the end of the rear part 2*d* on the position checking part 30, the end of the middle part 2*c* is slightly displaced from the position checking part 30.

In the circumstances, it is difficult to completely perform easy and precise determination of the installation position of the roofing materials 100 with reference to only the position checking part 30 in the process of installation. The roofing material 100 of the present embodiment is excellent in that it is possible to perform easy and precise determination of the installation position of the roofing materials 100 with reference to both the positioning marker 3 and the position checking part 30.

Figure 9:
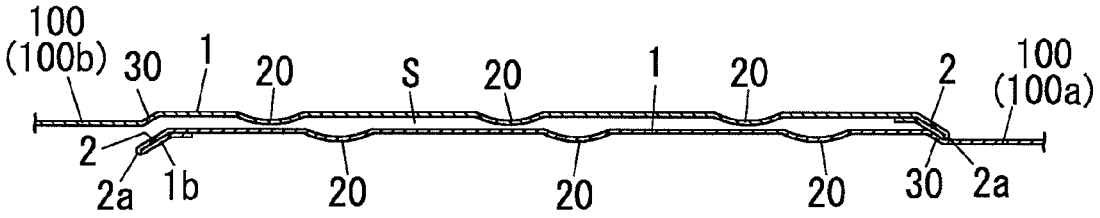
FIG. 9 relates to explanation about installation of the roofing material according to the present invention, and shows a sectional view illustrating connection of the roofing materials adjacent to each other.

As shown in FIG. 9, when the roofing materials 100 adjacent in the direction perpendicular to the inclining direction are overlapped with each other, there is a space S formed between the roofing materials 100 and 100. The space S is formed as described above, and therefore, even if rainwater comes into a gap between the two roofing materials 100, such rainwater can be drained outside through the space S. As a result, the water barrier property of the roof can be enhanced. Therefore, the space S serves as a drainage space between the roofing materials 100 overlapping each other.

In a case where the roofing material 100 includes the protrusion part 20, in order to enlarge the space S, it is sufficient that the roofing materials 100 are overlapped with each other such that the protrusions 20 of the respective roofing materials 100 are displaced in a left and right direction so as not to face each other in the upward and downward direction. In other words, it is sufficient that the adjacent roofing materials 100 are connected to each other such that the protrusion part 20 formed on the upper roofing material 100*b* is placed on the flat part of the surface of the main body 1 of the lower roofing material 100*a*. Thereby, it is possible to more easily drain rainwater which intrudes into a gap between the two roofing materials 100, and enhance the water barrier property of the roof more.

Figure 10A:
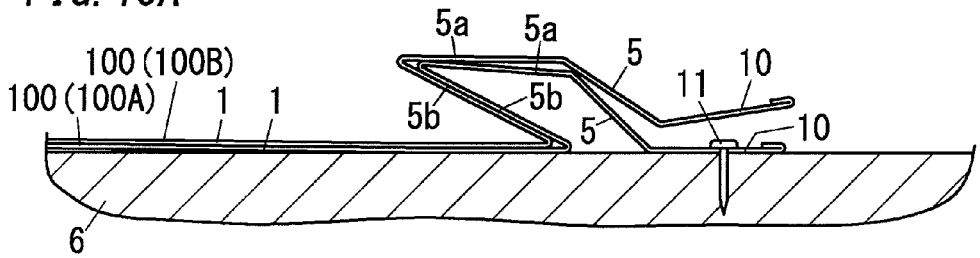
FIGS. 10A to 10D each relate to explanation about installation of the roofing material according to the present invention, and show a sectional view illustrating fitting of the roofing materials adjacent to each other.

The following detailed explanations referring to FIGS. 10A to 10D are made to the process of fixing the fixed piece 10 to a roof base 6 and the process of interconnecting the adjacent roofing materials 100 and 100 in the inclining direction. First, the roofing material 100 (100A) is placed on the roof base 6 while the second fitting part 5 of the roofing material 100 (100A) is pulled upward in the inclining direction such that the roofing material 100 (100A) is not bent, and the fixed piece 10 is fixed by driving a fixing member 11 such as a screw into the roof base 6 through the fixed piece 10. Next, a further roofing material 100 (100B) is placed so as to be adjacent to the fixed roofing material 100 (100A) in a lateral direction (direction perpendicular to the inclining direction). As mentioned above, the adjacent roofing materials 100A and 100B are overlapped and connected with each other so that the adjacent roofing materials 100A and 100B are displaced from each other in the lateral direction. Next, as shown in FIG. 10A, the fitting part 5 of the further roofing material 100B is put on the second fitting part 5 of the fixed roofing material 100A, and the fixed piece 10 of the further roofing material 100B is also put on the fixed piece 10 of the fixed roofing material 100A.

Figure 10B:
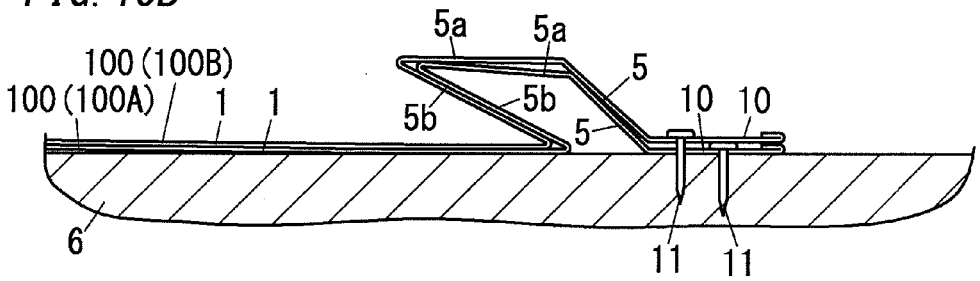

As shown in FIG. 10B, next, the fixed piece 10 of the further roofing material 100B is fixed to the roof base 6 by driving the fixing member 11 into the roof base 6 through the fixed piece 10 of the further roofing material 100B and the fixed piece 10 of the fixed roofing material 100A.

Figure 10C:
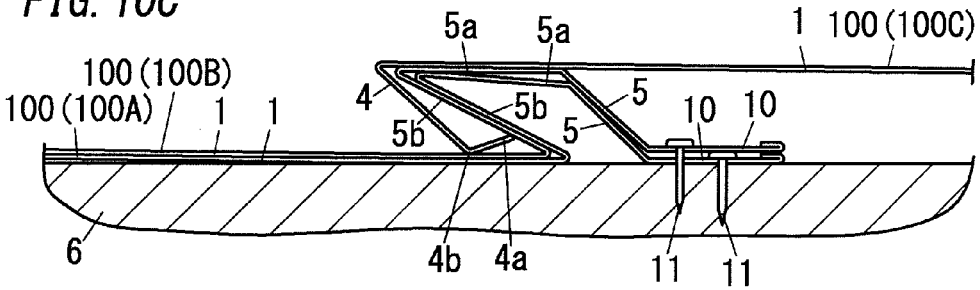
Figure 10D:
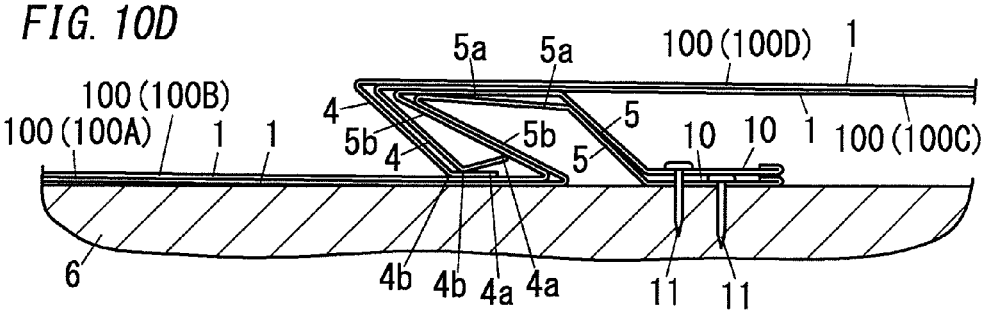
Figure 11:
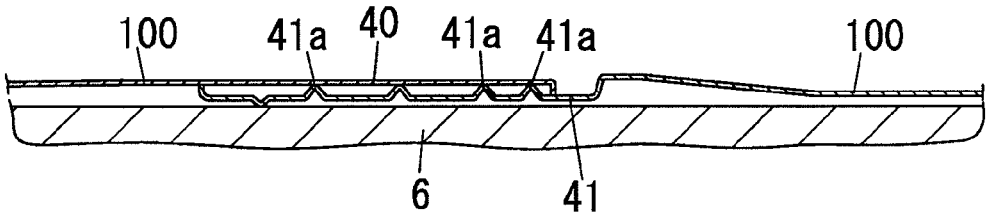
FIG. 11 PRIOR ART
FIG. 11 is a sectional view illustrating a conventional structure in which adjacent roofing materials are connected to each other.

As described above, a plurality of roofing materials 100A, 100B, . . . are installed sequentially so as to align in the lateral direction and thereafter another plurality of roofing materials 100C, 100D, . . . , are installed sequentially on the upper sides of the plurality of roofing materials 100 so as to align in the lateral direction. At this time, as shown in FIG. 10C, the first fitting part 4 of the roofing material 100C on the upward side is inserted between the main body 1 and the second fitting part 5 of the roofing material 100 on the downward side (upper roofing material 100B). Thus, the inserted first fitting part 4 is caught on the bottom surface of the second fitting part 5. Thereafter, as shown in FIG. 10D, the first fitting part 4 of the further roofing material 100 (100D) on the upward side is inserted between the first fitting part 4 of the roofing material 100C on the upward side and the main body 1 of the roofing material 100B on the downward side. Thereby, the first fitting part 4 of the roofing material 100D on the upward side is caught on the second fitting part 5 of the roofing material 100B on the downward side. In this way, at the point where the four roofing materials 100 (100A, 100B, 100C, 100D) are adjacent in the vertical direction and in the lateral direction, finally the two first fitting parts 4 and the two second fitting parts 5 are overlapped. By installing the plurality of roofing materials 100 sequentially according to the above procedure, it is possible to from the roof.

The invention claimed is:

1. A roofing material comprising:

a main body having a substantially flat plate shape;

a first fitting part formed at a long side end of the main body; and a second fitting part formed at a further long side end to extend almost an entire length of the further long side end, the roofing material further comprising at least one positioning marker which is provided to the second fitting part of the roofing material so as to indicate a position of a further roofing material, which is to be placed along a lengthwise direction of the roofing material, to the roofing material under a condition that a short side end of the main body and a short side end of the second fitting part of the roofing material are overlapped with a short side end of a main body and a short side end of a second fitting part of the further roofing material, respectively, the second fitting part of the roofing material having a shape to be caught on a shape of a first fitting part of a yet further roofing material which is to be placed along a widthwise direction of the roofing material, the second fitting part including a lower piece formed at the further long side end of the main body, an upper piece formed at an end of the lower piece, and a fixed piece protruding from an end of the upper piece away from the main body, a double-folded part, which is a metal plate bended at 180°, being formed at an end of the fixed piece, the at least one positioning marker being formed as a cut-out in the fixed piece such that the at least one positioning marker penetrates the double-folded part in a thickness direction;

wherein the main body includes an inclined piece formed at each short side end of the main body;

the inclined piece is bent so as to be inclined downward apart from the main body;

the main body is placed adjacent to the main body of the further roofing material;

an end of the inclined piece is formed so as to be in contact with a surface bent downward of the main body of the further roofing material; and the short side end of the roofing material is overlapped and laid to the short side end of the further roofing material while the end of the inclined piece of the roofing material is in contact with the surface of the main body of the further roofing material.

2. The roofing material according to claim 1, wherein:

the at least one positioning marker provided to the second fitting part comprises a first positioning marker and a second positioning marker; and the first positioning marker and the second positioning marker are formed such that a distance of the first positioning marker from the short side end of the second fitting part is substantially equal to a distance of the second positioning marker from a further short side end of the second fitting part.

3. A roof structure comprising two or more roofing materials according to claim 1, adjacent two roofing materials of the two or more roofing materials being connected under a condition that a short side end of a main body and a short side end of a second fitting part of one of the adjacent two roofing materials are overlapped with a short side end of a main body and a short side end of a second fitting part of the other of the adjacent two roofing materials respectively so that the side end of the second fitting part of one of the adjacent two roofing materials conceals the at least one positioning marker of the other of the adjacent two roofing materials.

4. The roofing material according to claim 1, wherein both side ends of the upper piece are cut off and the upper piece does not extend the entire length of the further long side end.

* * * * *